US005115791A

United States Patent [19]

Dore

[11] Patent Number: 5,115,791

[45] Date of Patent: May 26, 1992

[54] ENGINE CRANKCASE WITH CRANKCASE GAS EXHAUST AND OIL RECIRCULATION SYSTEMS

[75] Inventor: Jacques Dore, Villiers Saint Frederic, France

[73] Assignees: Automobiles Peugeot, Paris; Automobiles Citroen, Neuilly Sur Seine; Regie Nationale des Usines Renault S.A., Boulogne-Billancourt Cedex, all of France

[21] Appl. No.: 728,706

[22] Filed: Jul. 11, 1991

[30] Foreign Application Priority Data

Jul. 11, 1990 [FR] France ..... 90 08844

[51] Int. Cl.[5] ..... F01M 13/00; F02M 25/00

[52] U.S. Cl. ..... 123/572; 123/573; 123/196 R; 123/193.2

[58] Field of Search ..... 123/572, 573, 196 R, 123/41.86, 193 C, 41.74, 55 VS

[56] References Cited

U.S. PATENT DOCUMENTS

| | | | |
|---|---|---|---|
| 1,916,522 | 7/1933 | McCuen . | |
| 3,949,719 | 4/1976 | Bellanca et al. | 123/573 |
| 4,528,969 | 7/1985 | Senga | 123/572 |
| 4,541,399 | 9/1985 | Tanaka et al. | 123/572 |
| 4,603,673 | 8/1986 | Hiraoka et al. | 123/572 |
| 4,947,812 | 8/1990 | Inoue et al. | 123/572 |

FOREIGN PATENT DOCUMENTS

| | | |
|---|---|---|
| 2065069 | 7/1971 | France . |
| 2223562 | 10/1974 | France . |

*Primary Examiner*—E. Rollins Cross
*Assistant Examiner*—M. Macy
*Attorney, Agent, or Firm*—Burns, Doane, Swecker & Mathis

[57] ABSTRACT

The invention concerns a crankcase or cylinder block for an internal combustion engine of any type, for example, of the V or in-line cylinder type. The upper half of the crankcase comprises internal conduits which connect the upper part of the crankcase with the lower compartments separating the crankshaft bearings, these conduits making possible the exhaust of crankcase gases and the recycling of the engine oil and opening into a chamber of a flat shape, with said chamber and said internal conduits forming an integral as-cast system. The invention applies in particular to the automotive industry.

5 Claims, 3 Drawing Sheets

ENGINE CRANKCASE WITH CRANKCASE GAS EXHAUST AND OIL RECIRCULATION SYSTEMS

BACKGROUND OF THE INVENTION

The present invention relates to a crankcase or cylinder block for an internal combustion engine of any type, for example the V-shaped block or the in-line cylinder type block.

During operation of an internal combustion engine, combustion gas leaks occur at the piston rings causing the presence of unused gas in the crankcase. These crankcase gases must be exhausted to prevent a pressure rise in the crankcase that can reduce engine power as well as cause other undesirable effects. It is further desirable to recycle into the crankcase any engine oil introduced into the cylinder head, for example, from lubrication of the valves.

Crankcases have been proposed wherein internal conduits are provided to connect the crankcase surface facing the cylinder head with lower compartments separating the crankshaft bearings, in order to exhaust crankcase gases and recycle the engine oil.

However, these internal conduits of the prior art are complex in their configuration and have small cross sections for the passage of gas and oil. Furthermore, the conduits are obtained by machining or by means of core pins or fragile mold cores, so that the crankcases manufactured in this manner are expensive and lack adequate rigidity.

OBJECTS AND SUMMARY OF THE INVENTION

An object of the present invention, therefore, is to eliminate these disadvantages by providing a crankcase with internal conduits to exhaust crankcase gases and to recycle the engine oil, said conduits having a simple configuration and large passage cross sections, manufactured at a lower cost while increasing the rigidity of the crankcase by using a single, strong mold core.

In accordance with the invention, a cylinder head crankcase for an internal combustion engine, having a V or in-line cylinder configuration, includes internal conduits connecting the crankcase with compartments separating the crankshaft bearings, said conduits making possible the exhaust of crankcase gases as well as the recirculation of engine oil. The crankcase exhaust and recycling conduits open into a chamber of flattened shape, located adjacent to the lower compartments and traversed generally perpendicularly by the cylinders, said chamber and said conduits forming an as-cast system.

The invention is further characterized in that the system has additional passages connecting the aforementioned chamber with the lower compartments, the passages being operable for exhausting crankcase gases.

The crankcase is also characterized in that the internal conduits for recycling oil extend essentially parallel to the cylinders and connect respectively the chamber of the as-cast system with a cylinder-head gasket face and a lower face facing the crankcase. These oil recycling conduits are offset relative to each other.

It is further specified here that for an engine where the cylinders are placed in two lines in V-shape, the system chamber has a dihedral form, with a central part or edge connected with internal conduits extending between the two rows of cylinders and opening onto a crankcase face provided for mounting of a crankcase gas treatment device.

The invention is further characterized in that cooling chambers are formed around the cylinders for the circulation of a liquid coolant, the system chamber being located between the cooling chambers and the aforementioned lower compartments.

BRIEF DESCRIPTION OF THE DRAWINGS

Further advantages and characteristics of the invention will become apparent to those skilled in the art from the detailed description hereinbelow and the attached drawings, given solely as examples, wherein like reference numerals are applied to like elements and wherein.

DETAILED DESCRIPTION OF THE PREFERRED EMBODIMENT

Figure 2:
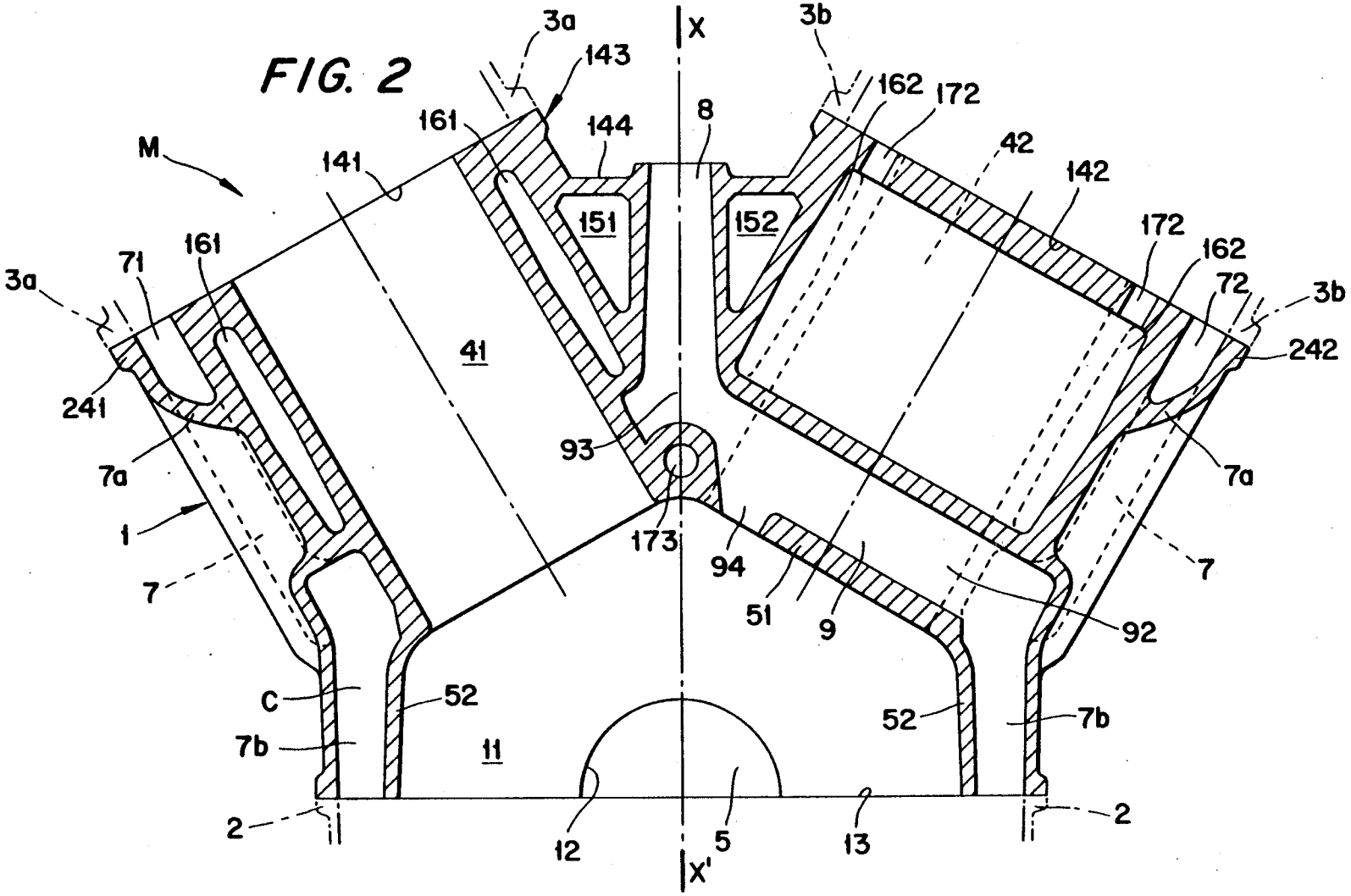
FIG. 2 is a view of a section through the crankcase of FIG. 1 on the line II—II.

In referring initially to FIG. 2, it is seen that an engine M comprises in particular an upper crankcase or cylinder block 1, an oil pan 2 (shown in part for the sake of clarity) and two cylinder heads 3*a* and 3*b* (shown in part for the sake of clarity) fastened to the crankcase 1.

Figure 1:
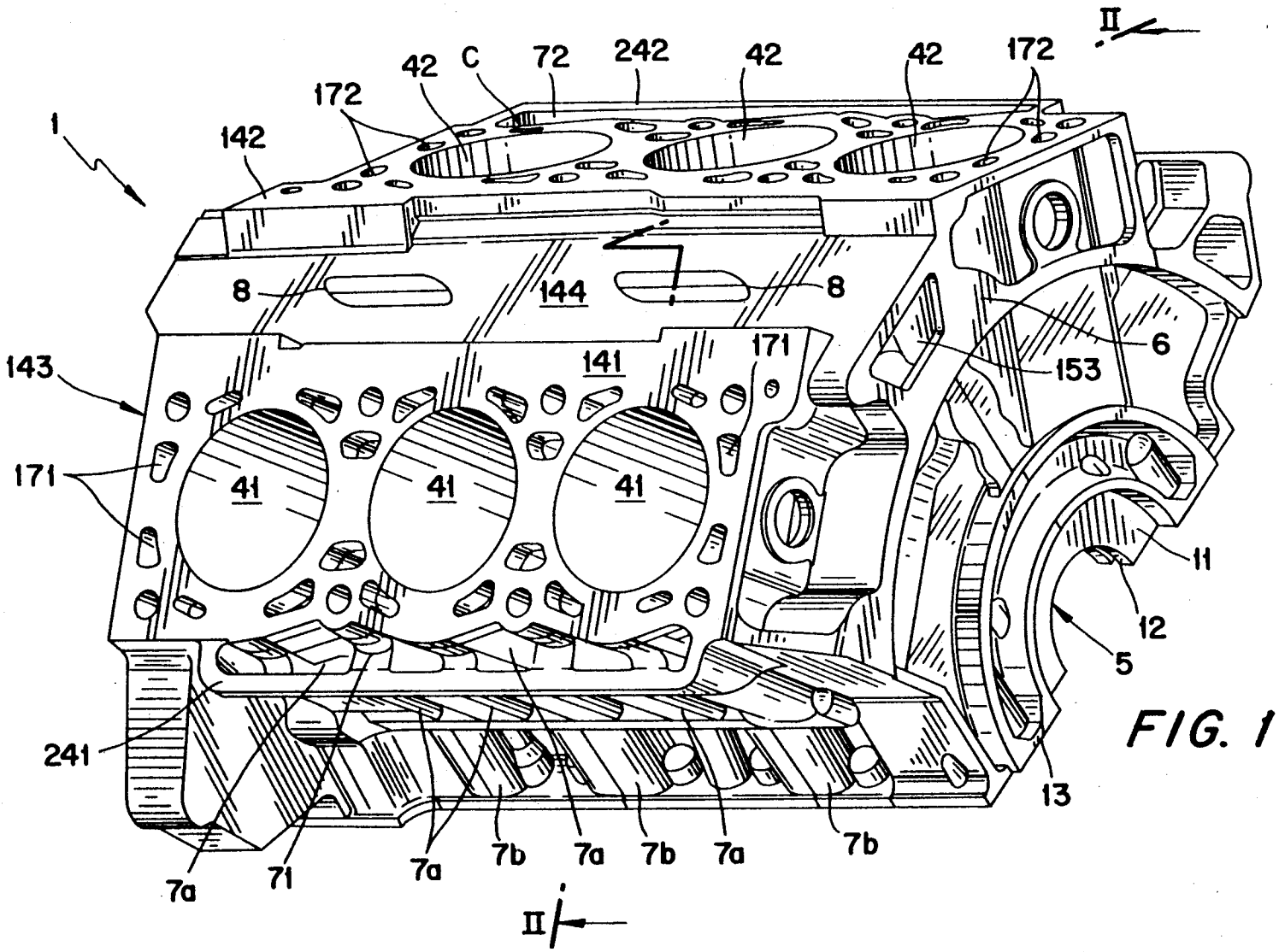
FIG. 1 is a perspective view of a crankcase according to the invention for an internal combustion engine of the V cylinder type.

According to the example shown in FIGS. 1 and 2, the engine M is a 6 cylinder engine type with a V-shaped block, i.e., it comprises two rows of three piston cylinders 41, 42 each, each row disposed on a corresponding side of a longitudinal plane X—X'. It is also noted that lower compartments 5 are separated by transverse walls 11 (only one is visible in FIG. 1 and 2) in which the crankshaft bearings 12 are formed. The lower compartments 5 in the crankcase 1 open onto a lower gasket face 13 against which the oil pan 2 is mounted.

One end of each cylinder 41, 42 opens into the upper part 143 of the crankcase I and the other end of each cylinder opens, into one of the lower compartments 5. The three aligned cylinders, designated by the reference symbol 41, are located on one side of the longitudinal plane X—X' and open onto a gasket face 141, on which the cylinder head 3*a* is mounted. The other three cylinders 42 are located in the crankcase 1 on the other side of the X—X' plane and open onto another gasket face 142 of the upper part 143, on which the cylinder head 3*b* is mounted.

It should be noted here that a sleeve (not shown) may be inserted into each cylinder 41, 42, for example, during the molding of the crankcase 1.

Two liquid coolant feed lines 151, 152 are provided in the crankcase 1 and extend essentially parallel to a longitudinal direction of the crankcase 1. The coolant feed lines 151, 152 are connected respectively with the cooling chambers 161, 162, one chamber being formed around each cylinder 41, 42 so as to permit the circulation of the liquid coolant in the crankcase 1.

Communication passages 171, 172 (see FIG. 1) of the cooling chambers 161, 162 communicate with the cylinder heads 3*a*, 3*b* and open respectively on the gasket faces 141, 142. The cooling liquid is introduced in the crankcase 1 by means of an opening 153 which opens into a traverse face 6 of the crankcase 1 that extends essentially parallel to the transverse walls 11 described above.

In FIG. 2 a longitudinal channel 173 for the circulation of oil under pressure extends in the longitudinal direction of the crankcase 2, along the upper part of the lower compartments 5.

The crankcase 1 also includes internal crankcase gas exhaust and oil recirculation lines which are described with reference to FIG. 3 as follows.

According to the invention, for each line of cylinders the crankcase 1 contains internal conduits 7 for recycling engine oil. The crankcase 1 also has internal exhaust conduits 8 for exhausting crankcase gases. The internal conduits 7, 8 open into a chamber 9 so as to form an as-cast system C with the crankcase 1, as shown in perspective in FIG. 3.

The chamber 9 (see FIG. 2) of the as-cast system C has the form of a flattened dihedron and extends in the vicinity of a top wall 51 of the lower compartments 5 of the crankcase 1. The chamber 9 (see FIG. 3) thus consists of two flat parts 91, 92 joined together. Each flat part 91, 92 of the chamber 9 (see FIG. 2) is traversed essentially at right angles by the cylinders 41, 42, respectively but there is no direct fluid communication between the cylinders and the flat parts of the chamber. A center part or edge 93 (see FIG. 3) of the chamber 9 forms an edge which extends in the longitudinal direction of the crankcase through the chamber 9.

Two exhaust conduits 8 have an oblong cross section, are positioned between the cylinders 41, 42, and extend from the upper part of the center part 93 to a center face 144 of the crankcase 1. A device (not shown) for the treatment of the crankcase gases may be mounted on the center face 144.

It is thus seen that the chamber 9 of the system C formed in the upper crankcase 1 is located between the cooling chambers 161, 162 and the lower compartments 5.

The recycling lines 7 (see FIG. 3) for engine oil extend laterally from each free end of the flat parts 91, 92 of the chamber 9 and consist of upper sections *7a* and lower sections *7b*. Sections *7a* are positioned above the associated flat parts 91, 92; whereas sections *7b* are positioned below the flat parts 91, 92.

According to the example illustrated, each flat part 91, 92 of the chamber 9 contains five upper sections *7a* and three lower sections *7b*, the lower sections having oblong cross sections. Portions of the upper sections *7a* of the recycling lines 7 are formed in the crankcase 1 so as to extend essentially parallel to the rows of cylinders 41, 42 (see FIG. 1). In the crankcase 1, these five upper sections *7a* are connected at their upper part by the channels 71, 72 (see FIG. 2), which open respectively onto the gasket faces 141, 142. It is seen in FIGS. 1 and 2 that each of the channels 71, 72 is located in the vicinity of a lateral edge of the corresponding gasket face 141, 142 of the crankcase and extends in a direction essentially parallel to the longitudinal direction of the crankcase.

The oblong cross sections of the internal conduits 7, 8 are large compared with prior art devices. In this connection, it will be noted from FIG. 3 that the transverse cross-sectional area of each conduit (i.e., measured in a plane generally perpendicular to the longitudinal axis of conduit) may be greater than about 25% or more of the longitudinal cross-sectional area of that conduit (i.e., measured in a plane containing the longitudinal axis of the conduit).

The lower sections *7b* of the recycling conduits 7 extend from top to bottom inside the lateral walls 52 of the compartments 5, generally parallel to the X—X' plane, between one of the flat parts 91, 92 of the chamber 9 and the gasket face 13 against which the oil pan 2 is mounted.

It may be seen already that the descent of the engine oil from the cylinder heads *3a, 3b* is improved by the oblong cross section of the sections *7a, 7b*. In addition, any emulsion of the oil is prevented as it is recycled to the level of the crankshaft bearings 12.

Figure 3:
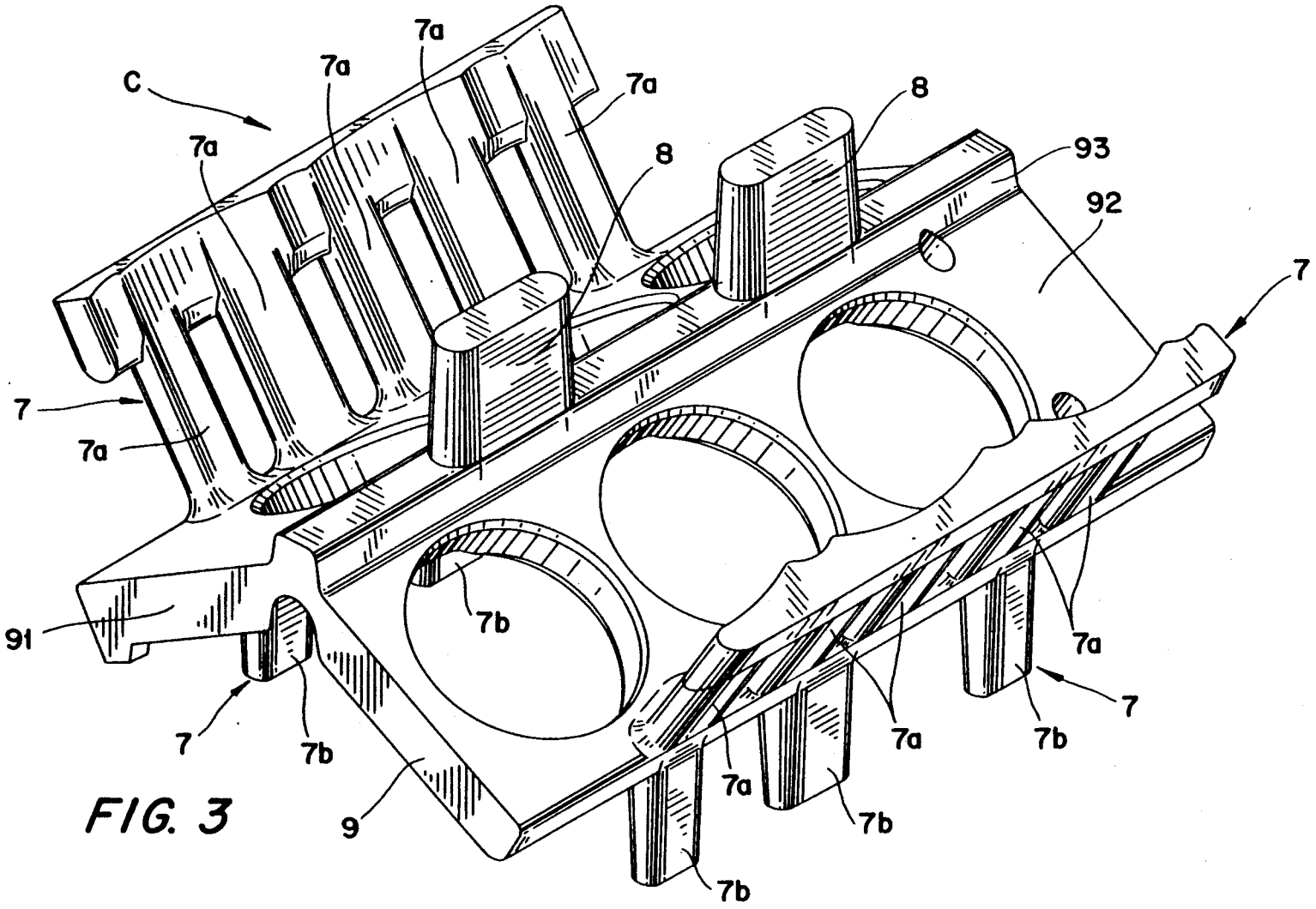
FIG. 3 illustrates in perspective the configuration of the chamber and the internal conduits which constitute the exhaust and recycling system according to the invention.

It is readily seen in FIG. 3 that the upper sections *7a* and the lower sections *7b* of the recycling conduits 7 are angularly offset relative to each other. In other words, the lower sections *7b* are essentially parallel to the X—X' plane and are not aligned exactly with the upper sections *7a*, which are themselves parallel to the cylinders 41, 42.

On the other hand (see FIG. 3), the lower sections *7b* open into the chamber 9 at points which are not located exactly in alignment with ends of the upper sections *7a*, which also open into each of the flat sections 91, 92 of the chamber 9. This offset (in the longitudinal direction) between the sections *7a* and *7b* makes it possible to "break" the flow of the oil toward the oil pan 2, and also improves the exhaust of the gases by allowing the gases retained in the oil of the oil pan 2 to escape through the lower sections *7b*.

In the vicinity of a lower part of the center part 93 (see FIG. 2) of the chamber 9, there are additional passages 94 which pass through the wall 51 to open into each compartment 5, so as to permit the optimum exhaust of gases from the crankcase by means of the conduits 8, for example, to a treatment device. It is possible to place the different lower compartments 5 of the crankshaft mounting into communication with each other by virtue of these passages 94 in order to improve the operation of the engine.

Due to the layout of the conduits, chambers and passages of the as-cast system C described above, the crankcase gas exhaust is considerably improved, in a manner such that than an engine M equipped with the system C offers less resistance to the displacement of the moving parts, such as pistons, connecting rods, etc.

According to the invention, therefore, a crankcase is obtained that is less expensive to manufacture and in which it is easy to provide gas exhaust and oil recycling conduits by placing a single block mold core similar to the circuit shown in FIG. 3 in the injection mold for the crankcase. Such a single block is placed in the course of the preparation of the mold between the cores producing the cooling chambers and the cores defining the crankshaft mounting compartments.

The crankcase according to the invention has the further advantage of being more rigid due to the different walls separating the chambers and the conduits, which also improve the sound absorption of the crankcase.

While the system C is described above for a V type engine, the system may also be adapted to an engine with in-line cylinders. The number of conduits together with the their cross sectional shapes may be adapted to the characteristics desired for operation of the engine.

It will now be seen that an engine crankcase has been described which overcomes the problems of the prior art. It should be understood that the invention is not limited to the embodiment described above, which is given merely as an example. It will be apparent to those skilled in the art that there are numerous modifications, variations, substitutions and equivalents for features of the invention that do not depart from the spirit and scope of the invention. Accordingly, it is expressly intended that all such modifications, variations, substitutions, and equivalents that fall within the spirit and scope of the invention as defined by the appended claims be embraced by the appended claims.

What is claimed is:

1. A crankcase for an internal combustion engine comprising a crankcase block having an upper part, a bottom, a plurality of piston cylinders, crankshaft bearings on the bottom, lower compartments separating the crankshaft bearings, internal conduits connecting the upper part of the crankcase block with the lower compartments separating crankshaft bearings, said internal conduits including internal exhaust conduits permitting exhaust of crankcase gases and internal recycling conduits for recycling of engine oil, said internal exhaust conduits and internal recycling conduits open into a chamber of a flattened shape, located adjacent to the lower compartments and traversed generally perpendicularly by the piston cylinders, said chamber and said internal conduits forming an as-cast system.

2. The crankcase according to claim 1, wherein the as-cast system further comprises passages connecting the chamber with each of the lower compartments for passage of crankcase gases.

3. The crankcase according to claim 1 wherein the internal conduits for oil recycling extend essentially parallel to the piston cylinders and connect the chamber of the as-cast system with a gasket face for mounting a cylinder head and with a lower face opposite the crankcase block, said internal conduits for recycling oil having portions offset with respect to each other.

4. The crankcase according to claim 1 wherein the piston cylinders are located in two rows in a V-shape, the chamber of the as-cast system has the configuration of a dihedron with a center part connecting the internal conduits for exhausting crankcase gases which extend between the two rows of cylinders and open onto a face of the crankcase block provided for the mounting a crankcase gas treatment device.

5. The crankcase according to claim 1 wherein cooling chambers are formed around the cylinders for the circulation of a liquid coolant, the chamber of the as-cast system being located between the cooling chambers and the lower compartments.

* * * * *